US010996037B2

(12) United States Patent
Minnicino et al.

(10) Patent No.: US 10,996,037 B2
(45) Date of Patent: May 4, 2021

(54) OBTURATOR FOR ROBUST AND UNIFORM DISCARD

(71) Applicant: U.S. Army Research Laboratory, Adelphi, MD (US)

(72) Inventors: Michael A. Minnicino, Baltimore, MD (US); John C. Lutz, Tannersville, PA (US); Robert S. Darcy, Morris Plains, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/120,496

(22) Filed: Sep. 4, 2018

(65) Prior Publication Data

US 2020/0072586 A1 Mar. 5, 2020

(51) Int. Cl.
*F42B 14/06* (2006.01)
*F41A 3/76* (2006.01)

(52) U.S. Cl.
CPC ..... *F42B 14/067* (2013.01); *F41A 3/76* (2013.01)

(58) Field of Classification Search
CPC ..... F42B 14/00; F42B 14/02; F42B 14/04; F42B 14/06; F42B 14/061; F42B 14/062; F42B 14/064; F42B 14/065; F42B 14/067; F42B 14/068; F42B 14/08
USPC ..... 102/520–528
See application file for complete search history.

(56) References Cited

U.S. PATENT DOCUMENTS 1,475,578 A * 11/1923 Hadfield ..... F42B 14/02 102/526
3,262,391 A * 7/1966 Shober ..... F42B 14/061 102/521
3,859,922 A * 1/1975 Kaplan ..... F42B 14/061 102/521
3,862,603 A * 1/1975 Kornblith ..... F42B 14/061 102/522
4,242,961 A * 1/1981 Moredock ..... F42B 14/02 102/527
4,360,954 A * 11/1982 Burns ..... B22D 19/04 102/521
4,430,942 A * 2/1984 Heyman ..... F42B 14/06 102/520
4,532,868 A * 8/1985 Gleichaut ..... F42B 14/02 102/527
4,552,071 A * 11/1985 Horais ..... F42B 14/02 102/524
H167 H * 12/1986 Forster ..... 102/442
4,719,860 A * 1/1988 Ruffle ..... F42B 14/061 102/521

(Continued)

OTHER PUBLICATIONS

May 18, 2016, Brief covering obturator discard improvement program modeling and simulation efforts. (Limited distribution).

(Continued)

*Primary Examiner* — Michael D David
(74) *Attorney, Agent, or Firm* — Alan I. Kalb

(57) ABSTRACT

Embodiments of an obturator are provided herein. In some embodiments, an obturator includes an annular body having an inner surface configured to interface with a projectile, an outer surface configured to interface with a gun bore, and geometric features disposed in the annular body to create regions of localized stress and strain upon discharge from a weapon.

3 Claims, 4 Drawing Sheets

(56) References Cited

U.S. PATENT DOCUMENTS 4,724,770 A * 2/1988 Fuchs ..... F42B 12/06 102/521
4,726,298 A * 2/1988 Sigg ..... F42B 14/064 102/523
4,736,666 A * 4/1988 Hillebrenner ..... F42B 14/064 102/520
4,756,255 A * 7/1988 Rosenberg ..... F42B 14/061 102/521
4,757,766 A * 7/1988 Ruffle ..... F42B 10/46 102/521
4,907,513 A * 3/1990 Manion ..... F42B 14/02 102/527
4,958,571 A * 9/1990 Puckett ..... F42B 14/061 102/522
5,052,305 A * 10/1991 Chiarelli ..... F42B 14/064 102/522
5,063,855 A * 11/1991 Diel ..... F42B 14/061 102/521
5,103,735 A * 4/1992 Kaste ..... F42B 14/061 102/521
5,133,262 A * 7/1992 Schaake ..... F42B 12/06 102/501
5,189,254 A * 2/1993 Berville ..... F42B 14/067 102/439
5,204,494 A * 4/1993 Meyer ..... F42B 14/061 102/521
5,265,539 A * 11/1993 Kurschner ..... F42B 14/06 102/206
5,297,492 A * 3/1994 Buc ..... F42B 14/061 102/513
5,359,938 A * 11/1994 Campoli ..... F42B 14/061 102/521
5,473,989 A * 12/1995 Buc ..... F42B 14/061 102/513
5,639,985 A * 6/1997 Garner ..... F42B 10/38 102/293
5,723,810 A * 3/1998 Sauvestre ..... F42B 7/10 102/439
7,013,811 B1 * 3/2006 Sebasto ..... F42B 14/061 102/520
7,568,433 B1 * 8/2009 Farina ..... F42B 10/24 102/439
7,594,472 B1 * 9/2009 Parratt ..... F42B 14/061 102/520
7,958,829 B1 * 6/2011 Kane ..... F42B 14/067 102/520
8,171,838 B2 * 5/2012 Heitmann ..... F42B 14/02 102/520
8,640,625 B1 * 2/2014 Wong ..... F42B 8/14 102/444
8,695,507 B1 * 4/2014 Musali ..... F42B 14/061 102/521
8,931,416 B2 * 1/2015 Schneider ..... F42B 12/60 102/449
9,677,863 B1 * 6/2017 Palathingal ..... F42B 14/061
2004/0244631 A1 * 12/2004 Eches ..... F42B 14/061 102/521
2005/0011397 A1 * 1/2005 Eches ..... F42B 14/061 102/523
2007/0234925 A1 * 10/2007 Dunn ..... F42B 14/064 102/522
2009/0107355 A1 * 4/2009 Park ..... F42B 14/061 102/521
2010/0236441 A1 * 9/2010 Heitmann ..... F42B 5/067 102/439
2011/0011297 A1 * 1/2011 Eches ..... F42B 14/062 102/521
2011/0146525 A1 * 6/2011 Caillat ..... F42B 14/064 102/521
2011/0214582 A1 * 9/2011 Glasser ..... F42B 12/44 102/439
2011/0308417 A1 * 12/2011 Glasser ..... F42B 10/42 102/374
2013/0000506 A1 * 1/2013 Minnicino, II ..... F42B 14/061 102/521
2015/0300796 A1 * 10/2015 Geswender ..... F42B 14/06 102/523
2015/0354929 A1 * 12/2015 Minnicino, II ..... F42B 30/02 102/520
2016/0033244 A1 * 2/2016 Minnicino, II ..... F42B 10/62 102/501
2016/0363425 A1 * 12/2016 Minnicino, II ..... F42B 14/02
2017/0080498 A1 * 3/2017 Burrow ..... C22C 38/58
2017/0299355 A1 * 10/2017 Trouillot ..... F42B 10/14
2018/0231358 A1 * 8/2018 Cury ..... B22F 7/062
2018/0356194 A1 * 12/2018 Kezerian ..... F42B 14/062
2019/0017792 A1 * 1/2019 Kezerian ..... F42B 14/067
2019/0271519 A1 * 9/2019 Cleary ..... F42B 14/02

OTHER PUBLICATIONS

Aug. 4, 2016, Draft ARL TR "Failure Simulation of 120-mm APFSDS Obturator at Muzzle Exit" sent to John Lutz for technical review and PM-MAS approval. (Limited distribution).
Minnicino M, "Failure Simulation of 120-mm APFSDS Obturator at Muzzle Exit," ARL-TR-7822, Sep. 2016. (Limited distribution).
Jan. 31, 2017, Slotted obturator discard modeling and simulation parametric study brief, Picatinny Arsenal, NJ. (Limited distribution).
Future—report covering modeling and simulation validation by recent testing data.

* cited by examiner

OBTURATOR FOR ROBUST AND UNIFORM DISCARD

GOVERNMENT RIGHTS IN THIS DISCLOSURE

Governmental Interest—The disclosure described herein may be manufactured, used and licensed by or for the U.S. Government. Research underlying embodiments of the present disclosure was sponsored by Program Manager Maneuver Ammunition Systems and developed by the U.S. Army Research Laboratory (ARL).

FIELD

Embodiments of the present disclosure generally relate to an obturator for use with a projectile.

BACKGROUND

Many munitions employ obturators that are design to discard, i.e., separate from the main projectile, at muzzle exit. An obturator is typically disposed around an exterior of a projectile so that the obturator interfaces with both the projectile and a gun bore. The primary function of an obturator is to provide a seal for propulsion gases. The inventors have discovered that at certain environmental conditions, an obturator can fail to discard.

Accordingly, the inventors have provided an improved obturator that can more reliably and uniformly discard from the main projectile at muzzle exit.

SUMMARY

Embodiments of an obturator are provided herein. In some embodiments, an obturator includes an annular body having an inner surface configured to interface with a projectile, an outer surface configured to interface with a gun bore, and geometric features disposed in the annular body to create regions of localized stress and strain upon discharge from a weapon.

In some embodiments, a munition cartridge includes a projectile; a sabot circumscribing the projectile; and an obturator disposed about the sabot, wherein the obturator includes one or more slots around the circumference of the obturator.

In some embodiments, an obturator for use with munitions includes an annular body having one or more slots arranged about a circumference of the obturator, wherein the obturator is capable of being deformed during a gun launch to form a first seal between a projectile and the obturator and second seal between a gun bore and the obturator.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only some embodiments of the disclosure and are therefore not to be considered limiting of scope, for the disclosure may admit to other equally effective embodiments.

Figure 1:
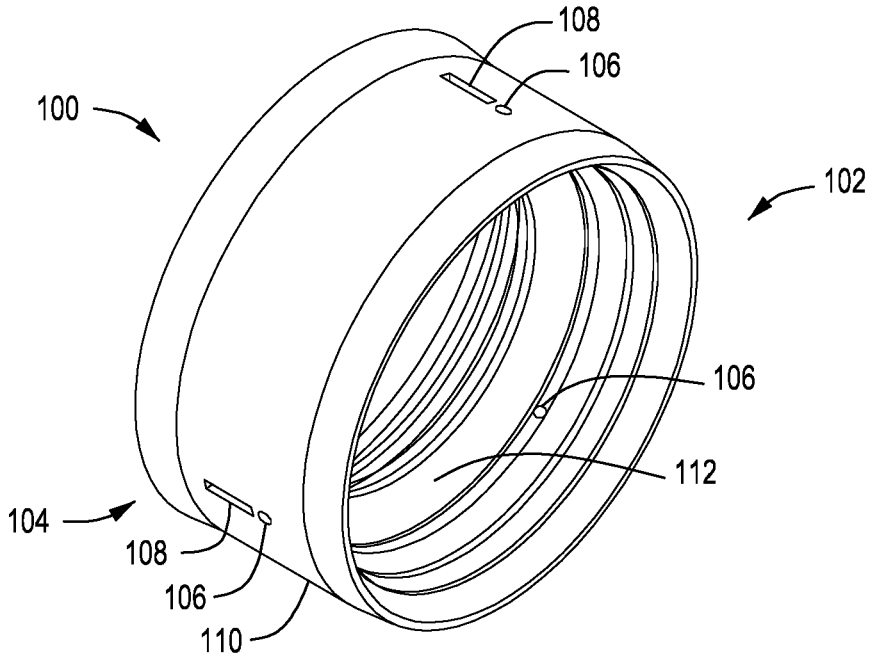
FIG. 1 depicts an isometric view of an obturator in accordance with some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

Embodiments of an improved obturator are provided herein. The obturator is part of a cartridge that also includes a projectile for use with munitions. The obturator is capable of being disposed between a projectile and a gun bore. The obturator has an annular shaped body. The obturator is fabricated from a softer and weaker material than either the projectile or the gun bore. The obturator may be formed of a polymer, for example, nylon, polypropylene, or the like. Accordingly, the obturator is capable of being deformed during gun launch to form a seal between both the projectile and the obturator and the gun bore and the obturator. The obturator is designed to discard from the projectile at a muzzle exit.

The obturator includes a finite number of geometric features to localize stress and strain in order to control the obturator fracture locations during obturator discard. The geometric features enable the obturator to work in a robust, uniform, and repeatable manner across a desired range of environmental conditions regardless of the obturator material age and prior environmentally conditioned state. The geometric features disclosed herein can be incorporated with existing obturators without significantly altering the functionality of the obturator behavior during gun launch or at muzzle exit. Alternatively, the geometric features disclosed herein can be incorporated during the manufacture of new obturators.

FIG. 1 depicts an isometric view of an obturator in accordance with some embodiments of the present disclosure. The obturator 100 has an annular shape including a leading end 102 and a trailing end 104. The obturator 100 has an inner surface 112 and an outer surface 110. The inner surface 112 is configured to interface with a projectile and the cartridge case. The outer surface 110 is configured to interface with a gun bore.

The projectile may include a main body such as a bullet, an arrow-like projectile, or the like. In some embodiments, the projectile includes an armor piercing, fin stabilized, discard sabot (APFSDS) long-rod penetrator. In some embodiments, the projectile may include a sabot circumscribing the main body of the projectile. The sabot is configured to discard from the main body after muzzle exit (i.e. when the projectile leaves the gun bore). The sabot includes one or more cylindrical sections, or sabot petals. The sabot can be held together by the obturator. If three sabot petals are used, each section covers a 120 degree arc. If six sabot petals are used, each section covers a 60 degree arc. The sabot petals are discarded by aerodynamic forces shortly after muzzle exit after obturator discard.

The outer surface 110 of the obturator 100 includes geometric features to create regions of localized stress and strain upon discharge from a weapon. In some embodiments, for example, the geometric features can be one or more slots 108. The one or more slots 108 are periodically arranged around the circumference of the obturator 100. In some embodiments, to ensure symmetry during discard, the number of slots corresponds with a multiple of the number of sabot petals of the projectile. For example, for use with a projectile with three sabot petals, the obturator can advantageously include three, six, or nine slots 108. The obturator 100 shown in FIG. 1 includes three slots 108. The one or more slots 108 extend from the outer surface 110 towards the inner surface 112. In some embodiments, the one or more slots 108 have a width of about 0.2 inches to about 0.3 inches. In some embodiments, the one or more slots 108 have a length along the outer surface 110 of the obturator 100 of about 0.6 inches to about 0.7 inches. The length of the one or more slots 108 may vary as the one or more slots 108 extend from the outer surface 110 towards the inner surface 112. The length of the one or more slots 108 also may depend on the geometry of the central region 306 of the obturator. The one or more slots 108 have a depth that can vary along the length. In some embodiments, the one or more slots 108 have a v-shaped cross section.

In some embodiments, as shown in FIG. 1, the one or more slots 108 may be machined from an exterior of the cartridge. Accordingly, the one or more slots 108 extend from the outer surface 110 of the obturator 100 towards the inner surface 112 of the obturator 100. Alternatively, the one or more slots may be machined from an inner surface of the obturator prior to assembly of the cartridge. Accordingly, the one or more slots extend from an inner surface of the obturator towards an outer surface of the obturator. In this embodiment, the one or more slots are not externally visible.

In some embodiments, the outer surface 110 of the obturator 100 includes one or more holes 106 extending from the outer surface 110 to the inner surface 112. In some embodiments, each hole of the one or more holes 106 can be disposed on a line parallel to a corresponding slot of the one or more slots 108. In some embodiments, as shown in FIG. 1, the number of slots 108 corresponds with the number of holes 106.

Figure 2:
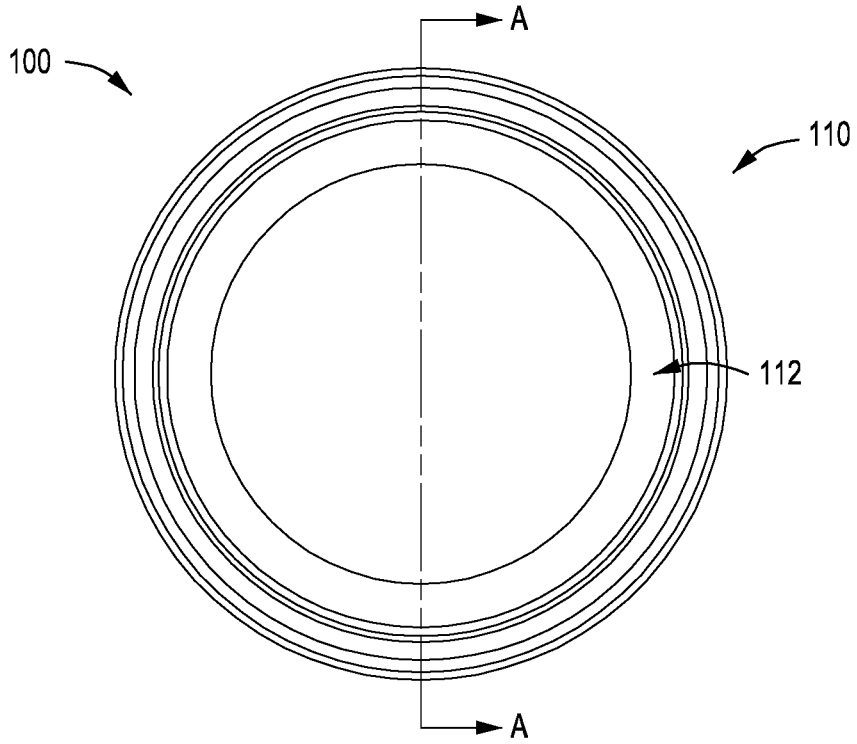
FIG. 2 depicts a front view of the obturator of FIG. 1.
Figure 3:
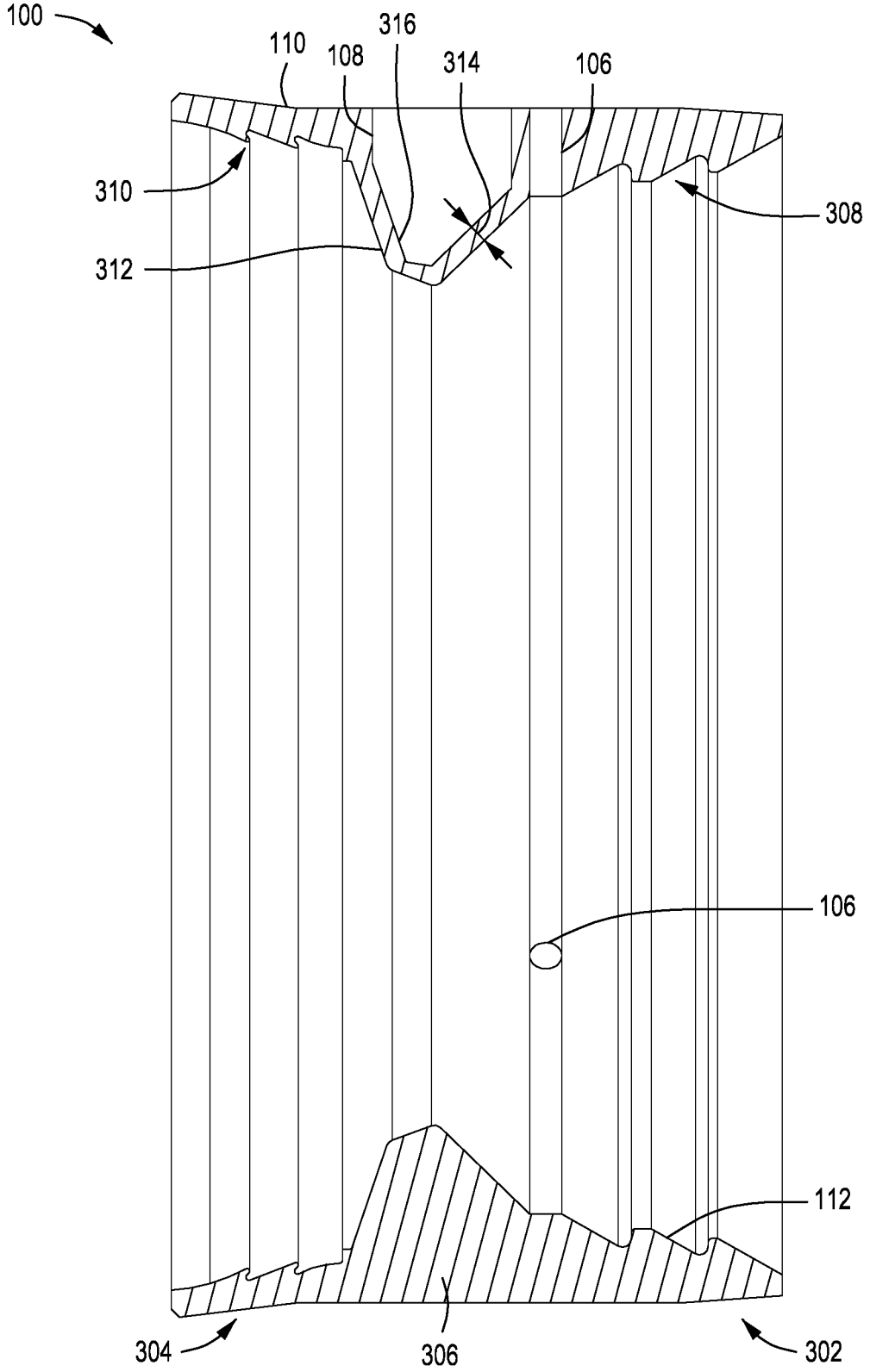
FIG. 3 depicts a cross sectional view of the obturator taken along line A-A of FIG. 2.

FIG. 2 depicts a front view of the obturator of FIG. 1. FIG. 3 depicts a cross sectional view of the obturator taken along an A-A line of FIG. 2. The obturator 100 includes a leading region 302, a trailing region 304, and a central region 306. The central region 306 is disposed between the leading region 302 and the trailing region 304. The leading region 302 includes a first sawtooth geometry 308 on the inner surface 112 of the obturator 100. The first sawtooth geometry 308 is configured to couple the obturator 100 to a projectile or a sabot of a projectile. The trailing region 304 includes a second sawtooth geometry 310 on the inner surface 112 of the obturator 100. The second sawtooth geometry 310 is configured to couple the obturator 100 to a cartridge case (see FIG. 5). The obturator 100 connects the projectile to the cartridge case to facilitate shipping and handling of the cartridge.

As shown in FIG. 3, the central region 306 includes the one or more slots 108. The one or more slots 108 extend from the outer surface 110 of the obturator 100 towards the inner surface 112 of the obturator 100. A web 312 is defined between a bottom surface 316 of the one or more slots 108 and the inner surface 112. In some embodiments, the web 312 has a generally uniform thickness. In some embodiments, the thickness 314 of the web 312 is about 2 mm. A geometry of the bottom surface 316 corresponds with a geometry of the inner surface 112. In some embodiments, as shown in FIG. 3, a distance between the outer surface 110 and the bottom surface 316 of the one or more slots 108 is not uniform along a length of the one or more slots 108 (i.e. bottom surface 316 is not parallel to outer surface 110).

Figure 4:
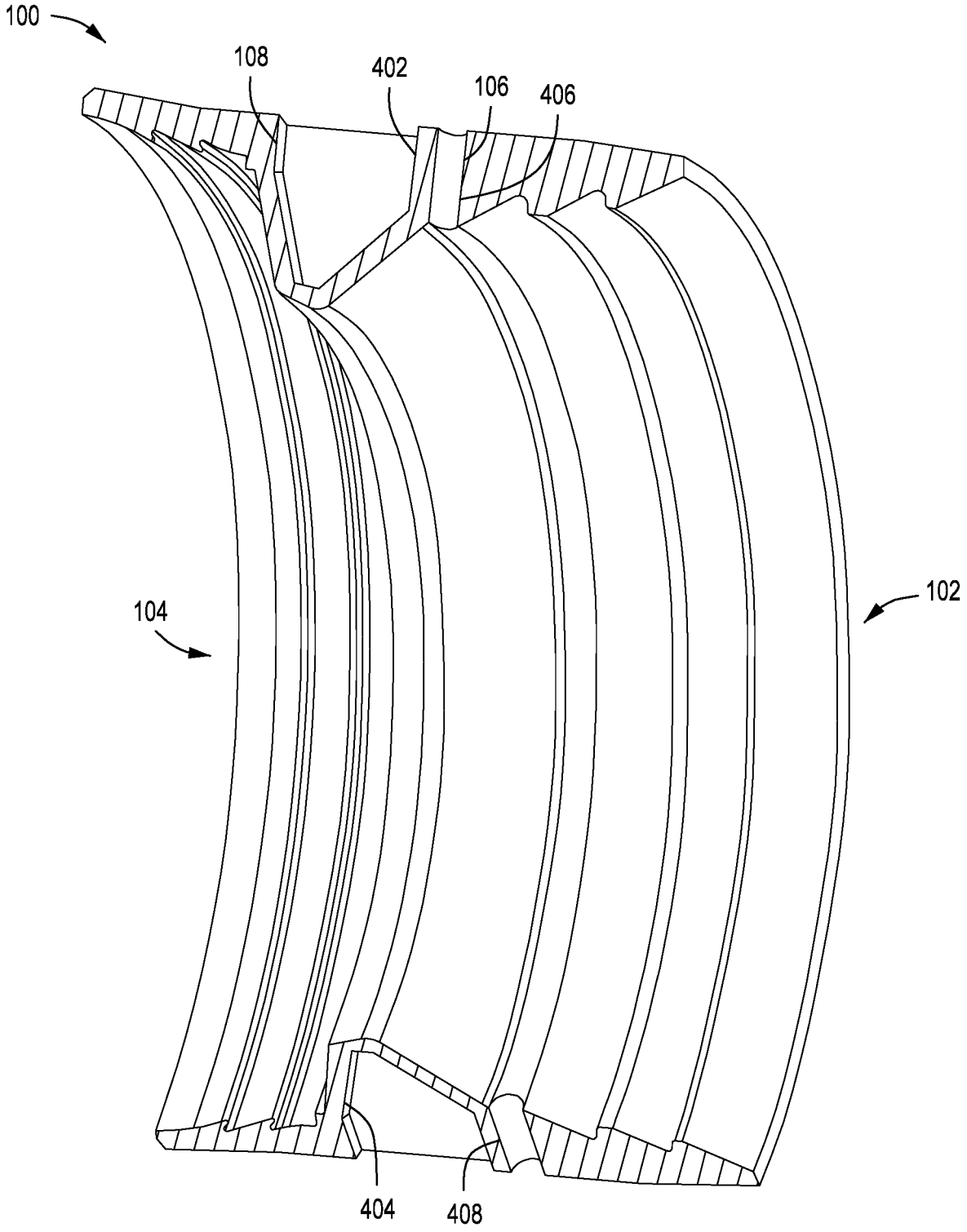
FIG. 4 depicts an idealized failed section of the obturator of FIG. 1.

FIG. 4 depicts an idealized failed section of the obturator of FIG. 1. The idealized failed section represents a 120 degree section of the obturator because the obturator of FIG. 1 includes three slots. The one or more slots 108 include a first slot 402 and a second slot 404. The one or more holes includes a first hole 406 and a second hole 408. The one or more slots represent a significant portion of a cross sectional area of the central region 306 of the obturator 100 as compared to the web 312. In use, the stress and strain exerted in the central region 306 induces failure of the obturator material at or near the one or more slots 108. Accordingly the idealized failed section is bounded by the first slot 402 and the first hole 406 at one end and the second slot 404 and the second hole 408 at another end.

Figure 5:
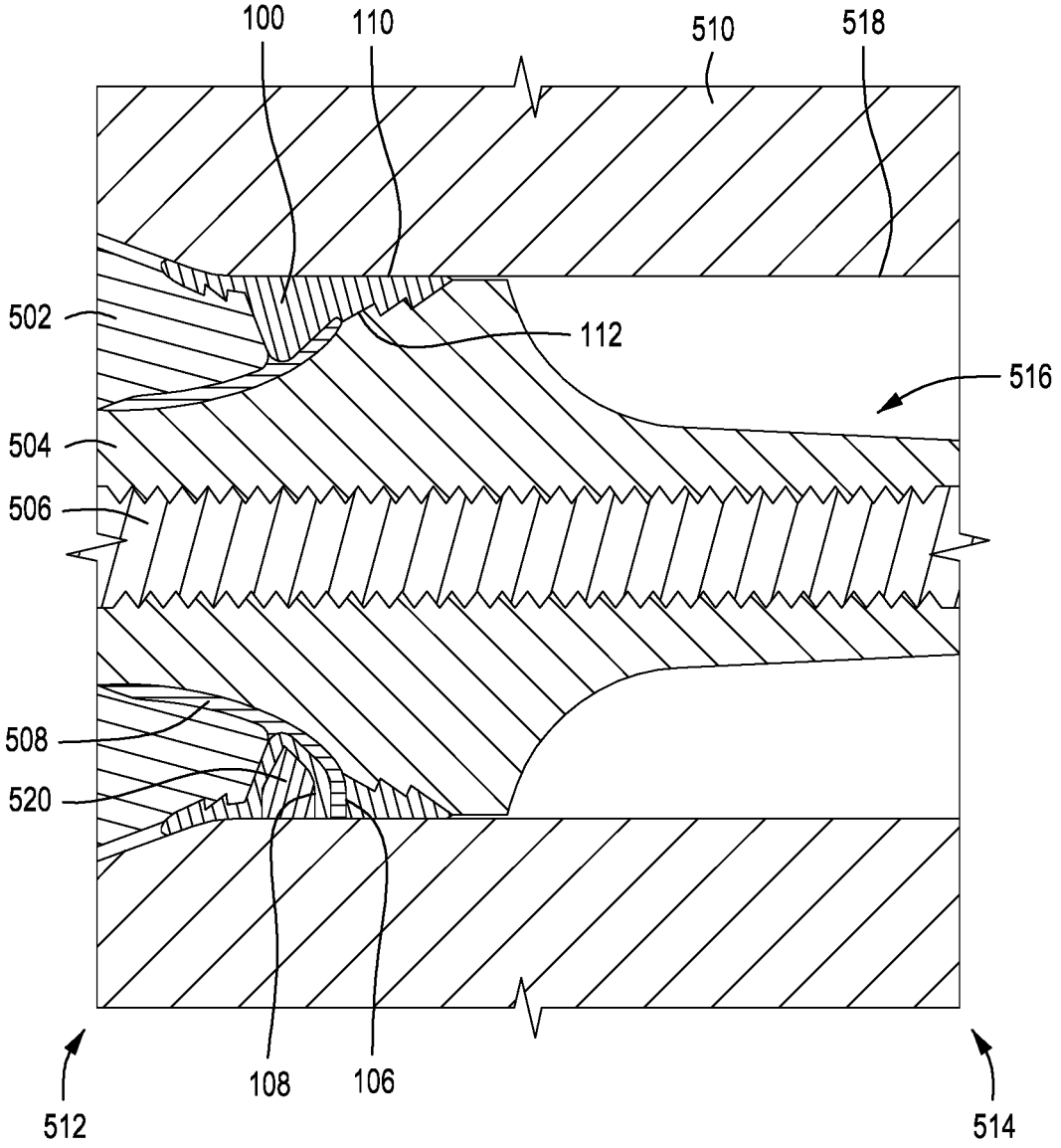
FIG. 5 depicts a cross sectional view of an obturator disposed within a gun bore in accordance with some embodiments of the present disclosure.

FIG. 5 depicts a cross sectional view of an obturator 100 disposed within a gun tube 510 in accordance with some embodiments of the present disclosure. The gun tube 510 includes a muzzle end 514 and a breech end 512. The gun tube 510 has a gun bore 518. The obturator 100 includes an outer surface 110 that is configured to interface with the gun bore 518. The obturator 100 includes an inner surface 112 that is configured to interface with a projectile 516. The inner surface 112 is also configured to interface with a cartridge case 502. In some embodiments, the projectile 516 includes a penetrator 506 and a sabot 504 that encloses the penetrator 506. The sabot 504 includes one or more cylindrical sections, or sabot petals. The sabot 504 can be held together by the obturator 100.

In some embodiments, a seal 508 is disposed between a portion of the obturator 100 and a portion of the sabot 504. In some embodiments, the seal 508 extends into and fills the one or more holes 106, as shown in FIG. 5. The seal 508 can be made of silicone, such as a room temperature vulcanizing silicone (e.g. JRTV silicone). In some embodiments, the seal 508 further extends between a portion of an interface between the sabot 504 and the cartridge case 502. In some embodiments, as shown in FIG. 5, the one or more slots are optionally filled with a polymer 520, such as a silicone polymer. The polymer 520 may be used as an additional sealant to limit the amount of moisture that can permeate across the web 312 of the obturator 100.

While the foregoing is directed to embodiments of the present disclosure, other and further embodiments of the disclosure may be devised without departing from the basic scope thereof.

The invention claimed is:

1. An obturator, comprising:

an annular body having an inner surface configured to interface with a projectile, an outer surface configured to interface with a gun bore wherein the annular body includes a central region disposed between a leading region and a trailing region, wherein the leading region includes a first sawtooth geometry, and wherein the trailing region includes a second sawtooth geometry; and three slots extending from an outer surface of the obturator towards an inner surface of the obturator, a plurality of holes disposed within the obturator, a web defined by the inner surface and a bottom surface of said slots, said web having a thickness of 2 millimeters at its thickest portion, disposed in the annular body to create regions of localized stress and strain upon discharge from a weapon gun bore.

2. The obturator of claim 1, wherein the first sawtooth geometry is disposed on said inner surface of the obturator, and wherein the first sawtooth geometry is configured to couple the obturator to a sabot.

3. The obturator of claim 1, wherein the second sawtooth geometry is disposed on said inner surface of the obturator, and wherein the second sawtooth geometry is configured to couple the obturator to a cartridge case.

* * * * *